US011638479B2

(12) United States Patent
Mishkal

(10) Patent No.: US 11,638,479 B2
(45) Date of Patent: May 2, 2023

(54) WEIGHT SUPPORTING COLLAPSIBLE STRUCTURES

(71) Applicant: POPIN TOYS LTD., Haifa (IL)

(72) Inventor: Ori Mishkal, Haifa (IL)

(73) Assignee: POPIN TOYS LTD., Haifa (IL)

( * ) Notice: Subject to any disclaimer, the term of this patent is extended or adjusted under 35 U.S.C. 154(b) by 506 days.

(21) Appl. No.: 16/631,296

(22) PCT Filed: Aug. 2, 2018

(86) PCT No.: PCT/IL2018/050861
§ 371 (c)(1),
(2) Date: Jan. 15, 2020

(87) PCT Pub. No.: WO2019/026080
PCT Pub. Date: Feb. 7, 2019

(65) Prior Publication Data

US 2020/0205562 A1 Jul. 2, 2020

Related U.S. Application Data

(60) Provisional application No. 62/540,097, filed on Aug. 2, 2017.

(51) Int. Cl.
*A47B 43/00* (2006.01)
*A47B 3/00* (2006.01)
(Continued)

(52) U.S. Cl.
CPC ..... *A47B 43/00* (2013.01); *A47B 3/002* (2013.01); *A47C 4/00* (2013.01); *A63H 33/008* (2013.01)

(58) Field of Classification Search
None
See application file for complete search history.

(56) References Cited

U.S. PATENT DOCUMENTS 3,148,821 A * 9/1964 Gardiner ..... B65D 5/3635 229/101
3,184,142 A * 5/1965 Rosenburg, Jr. ... B65D 5/48014 229/120.18
(Continued)

FOREIGN PATENT DOCUMENTS

WO 2013/144859 10/2013
WO 2015/181813 12/2015

*Primary Examiner* — Steven M Marsh
(74) *Attorney, Agent, or Firm* — The Law Office of Joseph L. Felber

(57) ABSTRACT

A collapsible structure with opposite support panels and tab panels, comprising: two structure panels; at least two support panels, each connected to the structure panels via two folding lines at opposite; and at least two tab panels, each connected to the structure panels via two folding lines at opposite sides, each contains at least two internal folding lines perpendicular to the tab folding lines; wherein when the structure is in a collapsed position, the panels are adjacent and generally parallel to each other, the structure panels are folded; and wherein when the structure is in an erected position, the support panels are perpendicular to the structure panels and the tab panels are folded by the internal folding lines, each tab panel partially adjacent to one of the support panels to shape a fixed rod supporting the internal folding lines and inserted to support a rigid distance between the structure panels.

13 Claims, 17 Drawing Sheets

(51) Int. Cl.
*A47C 4/00* (2006.01)
*A63H 33/00* (2006.01)

(56) References Cited

U.S. PATENT DOCUMENTS

| | | | | | |
|---|---|---|---|---|---|
| 3,229,889 | A * | 1/1966 | Vrana | B65D 5/48004 | 229/120.14 |
| 4,377,252 | A * | 3/1983 | Schillinger | B65D 5/48008 | 229/120.17 |
| 4,396,146 | A * | 8/1983 | Sieffert | B65D 5/3635 | 229/117.06 |
| 2008/0157582 | A1 | 7/2008 | Bertele | | |
| 2014/0231495 | A1* | 8/2014 | Wong | B65D 5/36 | 229/117.07 |
| 2019/0382154 | A1* | 12/2019 | Sollie | B65D 5/6605 | |
| 2020/0377275 | A1* | 12/2020 | Beauvoir | B65D 5/46184 | |
| 2021/0163172 | A1* | 6/2021 | Hallman | B31B 50/782 | |

* cited by examiner

900

WEIGHT SUPPORTING COLLAPSIBLE STRUCTURES

FIELD AND BACKGROUND OF THE INVENTION

The present invention, in some embodiments thereof, relates to collapsible structures and, more particularly, but not exclusively, to a weight supporting collapsible structures.

Foldable play structures are known in the art. However they are generally not suitable for children to climb on; and if they are suitable for children to climb on they generally fold into several parts and/or fold into large sizes which are generally heavy and not easily portable.

For example, the collapsible slide disclosed in EP 1348472 A1 is suitable for children to climb on, but employs structures which are large, heavy and not easily portable. The cardboard play structure disclosed in US 20110281495 A1 disassembles into several parts.

For another example, the pop-out play structure disclosed in US 20110281496A1 comprising a foldable pop up play structure; this structure is portable but not suitable for kids to climb on.

SUMMARY OF THE INVENTION

According to an aspect of some embodiments of the present invention there is provided a collapsible structure with opposite support panels and tab panels, comprising: a first and a second structure panels; at least two support panels, each one of the support panels is connected to the first and second structure panels via two support folding lines at opposite sides of the support panel; and at least two tab panels, each of the tab panels is connected to the first and to the second structure panels via two tab folding lines at opposite sides of the tab panel, each of the at least two tab panels contains at least two internal folding lines perpendicular to the tab folding lines; wherein when the structure is in a collapsed position, the first and second structure panels, the at least two support panels and the at least two tab panels are adjacent and generally parallel to each other, the first and second structure panels are folded; and wherein when the structure is in an erected position, the at least two support panels are perpendicular to the first and second structure panels and the at least two tab panels are folded by the at least two internal folding lines, each of the at least two tab panels is partially adjacent to one of the at least two support panels to shape a fixed rod supporting the at least two internal folding lines and inserted to support a rigid distance between the first structure panel and the second structure panel.

Optionally, the two support folding lines are parallel for at least one of the at least two support panels.

Optionally, when the structure is in a collapsed position, each of the first and second structure panels are folded along a divide folding line wherein a length of the collapsed structure is half a length of the first structure panel and one of the tab panels.

Optionally, the at least two tab folding lines are parallel to the at least two support folding lines.

Optionally, when the structure is in a collapsed position, the at least two tab panels are folded along at least one of the at least two internal folding lines.

Optionally, when the structure is in erected position, at least one of the at least two tab panels is used as a seat.

Optionally, the collapsible structure further comprises: a cross panel connected to the first structure panel via a cross folding line perpendicular to the at least two support folding lines; wherein when the structure is in erected position, the cross panel is perpendicular to the first structure panel and to the second structure panel.

More optionally, when the structure is in erected position, the cross panel is horizontal and used as a table.

More optionally, the collapsible structure further comprises: a ground support panel connected to the cross panel via a ground support cross folding line perpendicular to the cross folding line; wherein when the structure is in erected position, the ground support panel is perpendicular to the cross panel and the ground to provide more structural strength.

Optionally, each of the at least two tab panels includes a longitudinal folding line perpendicular to the at least two internal folding lines; and wherein when the structure is in collapsed position, the at least two tab panels are folded along the longitudinal folding lines.

According to some embodiments of the invention there is provided a method for erecting the collapsible structure, comprising: providing the collapsible structure in a collapsed position; unfolding the first and second structure panels; separating between the first structure panel and the second structure panel; increasing the distance between the first structure panel and the second structure panel so the at least two support panels are perpendicular to the first and second structure panels; folding each of the at least two tab panels by the at least two internal folding line; and inserting each of the at least two tab panels between the first structure panel and the second structure panel to support the rigid distance between the first structure panel and the second structure panel.

According to an aspect of some embodiments of the present invention there is provided a collapsible structure with crossing tab panels, comprising: a first and a second structure panels; at least two support panels, each one of the support panels is connected to the first and second structure panels via two support folding lines at opposite sides of the support panel; and a first and a second tab panels, each connected to the first and second structure panels respectively via a tab folding line at a top side of each the respective first and second structure panels, each of the tab panels contains at least one internal folding line parallel to the tab folding line; wherein when the structure is in a collapsed position, the first and second structure panels, the at least two support panels and the first and second tab panels are adjacent and generally parallel to each other, the first and second structure panels are folded; and wherein when the structure is in an erected position, the at least two support panels are perpendicular to the first and second structure panels and the at least two tab panels are folded by the respective at least one internal folding line, each partially adjacent to an opposing of the respective first and second structure panels.

Optionally, the two support folding lines are parallel for at least one of the at least two support panels.

Optionally, when the structure is in a collapsed position, each of the first and second structure panels are folded along a divide folding line wherein a length of the collapsed structure is half a length of the first structure panel and one of the support panels.

Optionally, the at least one tab folding line is perpendicular to the at least two support folding lines.

Optionally, when the structure is in a collapsed position, the at least two tab panels are folded along at least one of the at least two internal folding lines.

Optionally, when the structure is in erected position, at least one of the at least two tab panels is used as a seat.

Optionally, each of the at least two support panels includes a longitudinal folding line parallel to the two support folding lines; and wherein when the structure is in collapsed position, the at least two support panels are folded along the longitudinal folding lines.

Optionally, the collapsible structure further comprises: a cross panel connected to the first tab panel via a cross folding line perpendicular to the tab support folding line; wherein when the structure is in erected position, the cross panel is perpendicular to the first structure panel and to the first tab panel.

Optionally, the collapsible structure further comprises: at least one tab panel connected at a bottom side of one of the first and second structure panels.

According to some embodiments of the invention there is provided a method for erecting the collapsible structure, comprising: providing the collapsible structure in a collapsed position; unfolding the first and second structure panels; separating between the first structure panel and the second structure panel; increasing the distance between the first structure panel and the second structure panel so the at least two support panels are perpendicular to the first and second structure panels; folding the first and second tab panels by the at least one internal folding line; and inserting each of the first and second tab panels to be partially adjacent to an opposing of the respective first and second structure panels.

According to an aspect of some embodiments of the present invention there is provided a collapsible structure with parallel cells, comprising: a first and a second structure panels; a first and a second outer support panels and a middle support panel, each one of the outer and middle support panels is connected to the first and second structure panels via two support folding lines at opposite sides of the support panel; a first and a second inner support panels; and at least two foldable panels, each of the at least two foldable panels is connected to the middle support panel and connected to at least one of the first and second inner support panels at opposite sides of the foldable panel; wherein when the structure is in a collapsed position, the first and second structure panels, the at least two support panels and the at least two tab panels are adjacent and generally parallel to each other; and wherein when the structure is in an erected position, all the support panels are perpendicular to the first and second structure panels and the first and a second inner support panels are adjacent to first and a second outer support panels respectively.

Optionally, the at least two foldable panels includes a top foldable panel and a bottom foldable panel, each of the foldable panels is connected to the middle support panel via an internal folding line in the middle of the foldable panel, and connected to the first and to the second inner support panels via two inner support folding lines at opposite sides of the foldable panel.

More optionally, when the structure is in a collapsed position the top and bottom foldable panels are folded by the internal folding line, and when the structure is in an erected position the top and bottom foldable panels are unfolded.

Optionally, the support folding lines are parallel for at least one of the outer and middle support panels.

Optionally, the first structure panel includes at least one cut to create an opening to the structure.

Optionally, the collapsible structure further comprises: at least one intermediate panel connected to the middle support panel and one of the first and second inner support panels.

More optionally, the intermediate panel is horizontal and used as a shelf.

More optionally, two of the at least two foldable panels and one of the first and second inner support panels are included in one panel having two folding lines each connecting one of the foldable panels to the inner support panel; and wherein the panel is connected to the middle support panel via two folding lines at opposite sides of the panel.

According to some embodiments of the invention there is provided a collapsible structure comprising at least two units of the described collapsible structure, the units are connected via a support folding line of each of the units.

According to some embodiments of the invention there is provided a collapsible structure comprising at least two units of the described collapsible structure, the units include a mutual outer support panel.

According to some embodiments of the invention there is provided a method for erecting the collapsible structure, comprising: providing the collapsible structure in a collapsed position; separating between the first structure panel and the second structure panel; increasing the distance between the first structure panel and the second structure panel so the first and second outer support panels are perpendicular to the first and second structure panels; separating between the first inner support panel and the middle support panel and between the second inner support panel and the middle support panel; increasing the distance between the first inner support panel and the second inner support panel; and unfolding the top foldable panel and a bottom foldable panel to support a rigid distance between the first structure panel and the second structure panel.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF EMBODIMENTS OF THE INVENTION

Figure 1A:
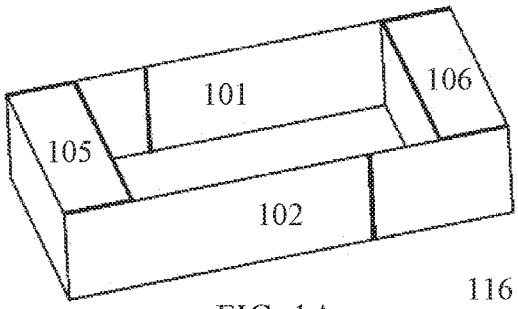
FIGS. 1A, 1B, 1C, 1D, 1E, 1F and 1G are schematic illustrations of a collapsible structure with opposite support panels and tab panels at different collapsing states, according to some embodiments of the present invention.
Figure 1B:
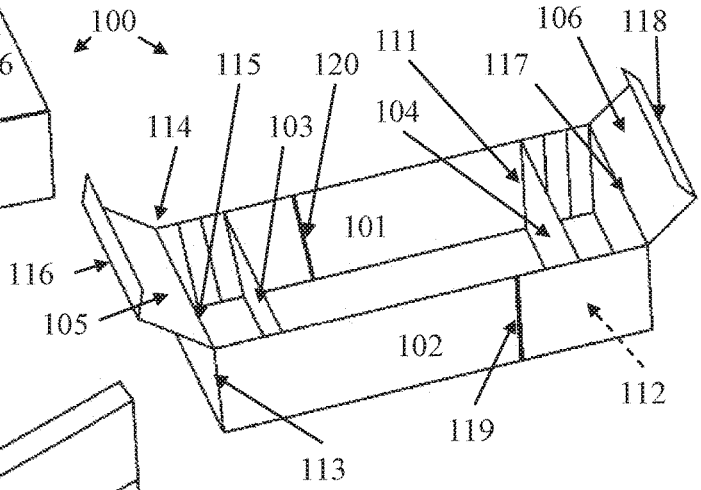

The present invention, in some embodiments thereof, relates to collapsible structures and, more particularly, but not exclusively, to a weight supporting collapsible structures.

For foldable play structures to be suitable for children to climb on, they must have general structural strength and specifically structural strength for weight put on top of the structure and/or on top of parts of the structure. According to some embodiments of the present invention, there are provided collapsible structures that are relatively strong to external forces, for example, carrying weight, and may be used to build play structures that are foldable as well as safe from breaking and/or crushing when climbed by children. For example, a play structure may withstand carrying weight of up to 150 kilograms.

The collapsible structures may also be used to construct other structures, such as furniture and/or any other structure that requires capability of being folded up to a straightened structure and stored as well as structural strength.

The collapsible structures are made of panels connected by folding lines. The panels may be made, for example, from cardboard, corrugated material, corrugated plastic, paper, paperboard, honeycomb material, plastic sheet, plastic film, metal sheet, compound material sheet and/or any other material according to the size and required structural strength. The folding lines may be made by folding the sheets, when relatively soft material is used. For some rigid materials, etching may be required before folding. For hard materials, the folding lines may be made by using flexible connections between the panels, such as hinges. Also, the folding lines may be made by differences in thickness, for example thinner material along a line.

The panels may be of any thickness, according to the size and required structural strength. For example, two-layer cardboard of thickness of 5 millimeters (mm), three-layer reinforced cardboard of thickness of between 5 mm and 15 mm, plastic sheets of thickness of between 0.5 mm and 1.5 mm and/or any other thickness.

According to some embodiments of the present invention, there is provided a collapsible structure with opposite support panels and tab panels. The structure contains two structure panels, at least two support panels each connected to both structure panels via two support folding lines at opposite sides of the foldable support panel, and at least two foldable tab panels each connected to both structure panels via two tab folding lines. The foldable tab panel contains at least two internal folding lines perpendicular to the tab folding lines.

When the structure is in a collapsed position, the panels are adjacent and generally parallel to each other, while the structure panels are folded. When the structure is in an erected position, the structure panels are straightened and the tab panels are folded by the internal folding lines to shape a fixed rod which supports the internal folding lines and inserted to support a rigid distance between the structure panels.

According to some embodiments of the present invention, there is provided a collapsible structure with crossing tab panels. The structure contains two structure panels, at least two support panels each connected to both structure panels via two support folding lines at opposite sides of the foldable support panel and two foldable tab panels each connected one of the structure panels via a tab folding lines. The foldable tab panel contains at least one internal folding line parallel to the tab folding lines.

When the structure is in a collapsed position, the panels are adjacent and generally parallel to each other, while the structure panels are folded. When the structure is in an erected position, the structure panels are straightened and each tab panel is folded by the internal folding lines to be partially adjacent to the structure panel opposite to it.

According to some embodiments of the present invention, there is provided a collapsible structure with parallel cells. The structure contains two structure panels, two outer support panels and a middle support panel, two inner support panels and at least two (top and bottom) foldable panels. The outer and middle support panels are each connected to both structure panels at opposite sides of the foldable support panel. The foldable panels are each connected to the middle support panel and to one or more of the inner support panels.

When the structure is in a collapsed position, the panels are adjacent and generally parallel to each other, while the foldable panels are folded. When the structure is in an erected position, the foldable panels are straightened. All of the support panels are then perpendicular to the structure panels and to the foldable panels.

The structures have structural strength for external force applied on the structure panels from all sides and specifically for weight put on top of the structures.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIGS. 1A, 1B, 1C, 1D, 1E, 1F and 1G are schematic illustrations of a collapsible structure with opposite support panels and tab panels at different collapsing states, according to some embodiments of the present invention.

The collapsible structure 100 contains a first structure panel 101 and a second structure panel 102. Collapsible structure 100 also contains at least two support panels 103 and 104 each connected to first structure panel 101 and second structure panel 102 via two support folding lines, optionally parallel, at opposite sides of the foldable support panel, 111 and 112. Collapsible structure 100 also contains at least two tab panels 105 and 106 connected to structure panels 101 and 102 via tab folding lines such as 113 and 114, optionally parallel to support folding lines 111 and 112. Tab panels 105 and 106 contain at least two internal folding lines such as 115 and 116 parallel to tab folding lines 113 and 114.

Figure 1C:
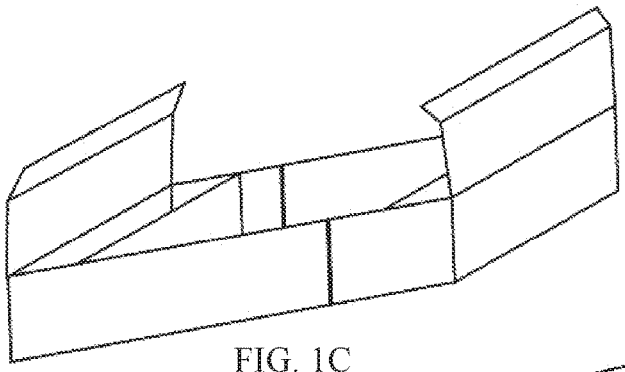
Figure 1D:
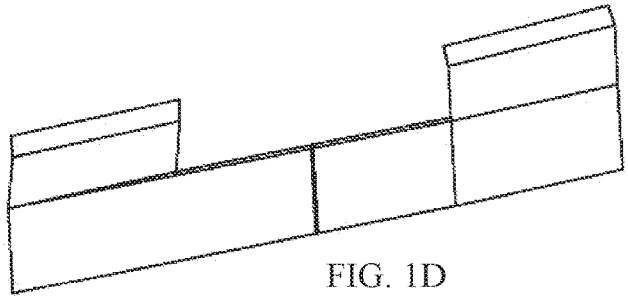
Figure 1E:
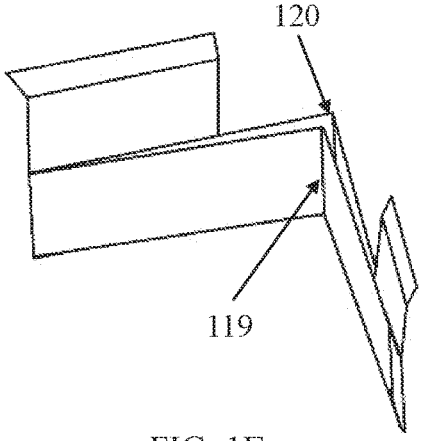
Figure 1F:
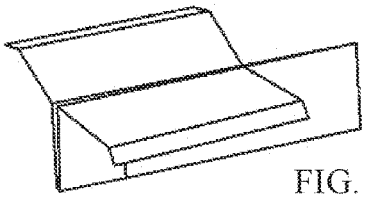
Figure 1G:
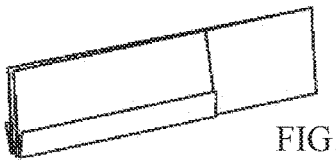

When collapsible structure 100 is in a collapsed position, as shown at FIG. 1G, panels 101-106 are adjacent and generally parallel to each other, while structure panels 101 and 102 are folded along a main folding line, for example made by divide folding lines 119 and 120. Optionally, structure panels 101 and 102 are folded so the length of the collapsed structure is half the length of a structure panel and a tab panel. Optionally, tab panels 105 and 106 are folded by one or more of internal folding lines 115, 116, 117 and 118.

When collapsible structure 100 is in an erected position, as shown at FIG. 1A, structure panels 101 and 102 are straightened and tab panels 105 and 106 are folded by internal folding lines 115, 116, 117 and 118 respectively to a shape fixed rod and inserted to support a rigid distance between first structure panel 101 and second structure panel 102. The fixed rods may be used for example as seats, as they have structural strength.

Reference is now made to FIGS. 2A, 2B, 2C and 2D which are schematic illustrations of exemplary collapsible structures with opposite support panels and tab panels, according to some embodiments of the present invention.

Figure 2A:
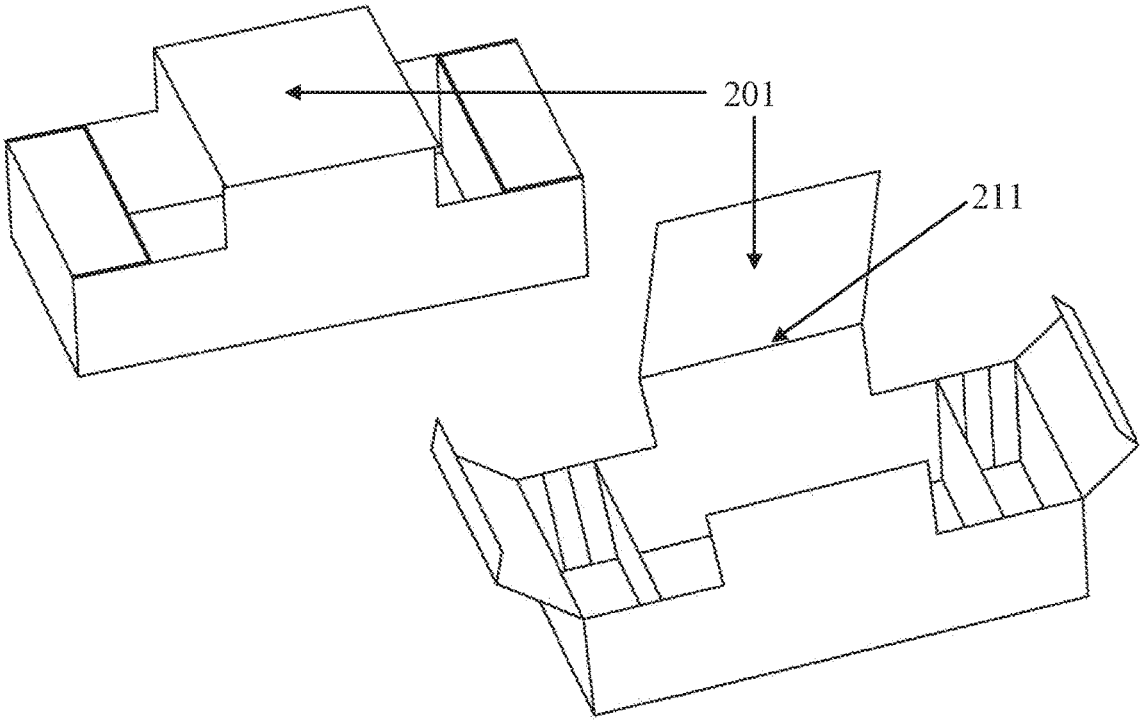
FIG. 2A is a schematic illustration of a collapsible structure with opposite support panels and tab panels and a cross panel, according to some embodiments of the present invention.

Optionally, the collapsible structure include a cross panel 201, as shown at FIG. 2A. Cross panel 201 may be connected to structure panel 101 via a cross folding line 211 perpendicular support folding lines 111 and 112. When collapsible structure 100 is in an erected position, cross panel 201 is perpendicular the structure panels. Cross panel 201 may be horizontal and may be used for example as a table.

Figure 2B:
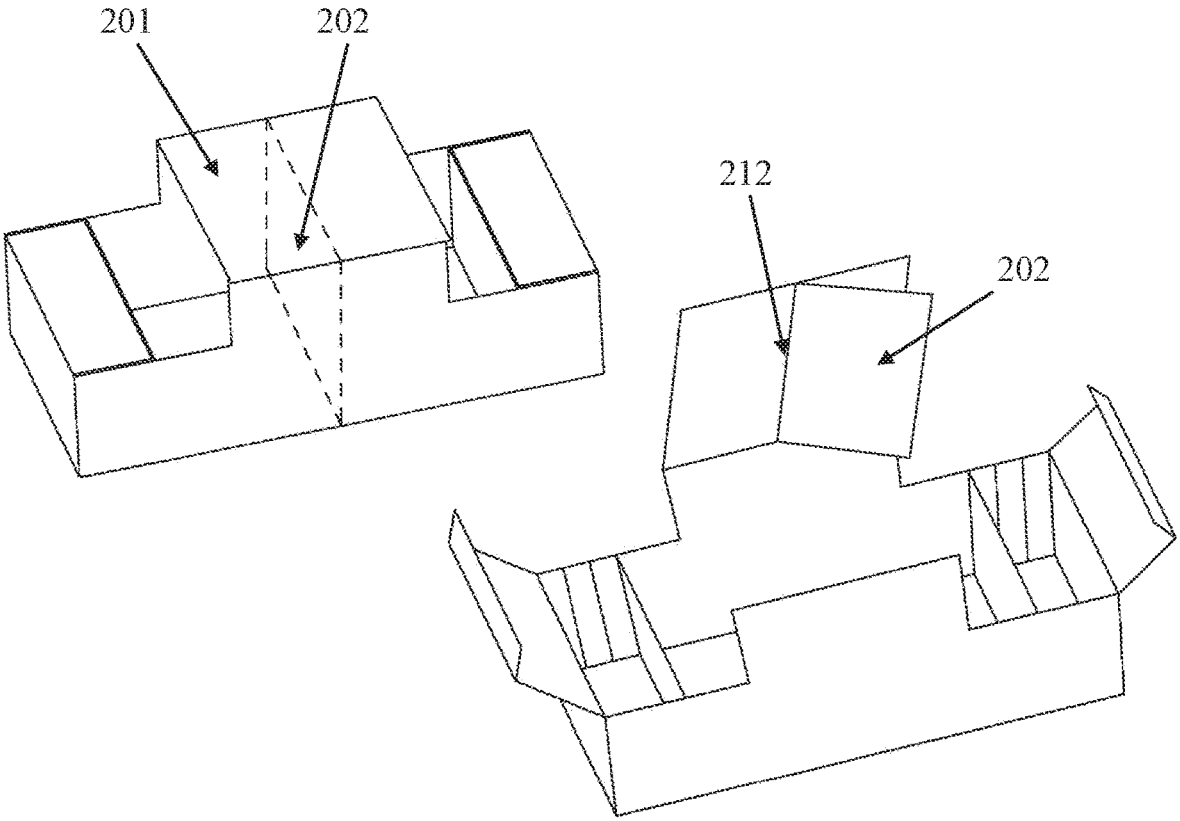
FIG. 2B is a schematic illustration of a collapsible structure with opposite support panels and tab panels, a cross panel and a ground support panel, according to some embodiments of the present invention.
Figure 2C:
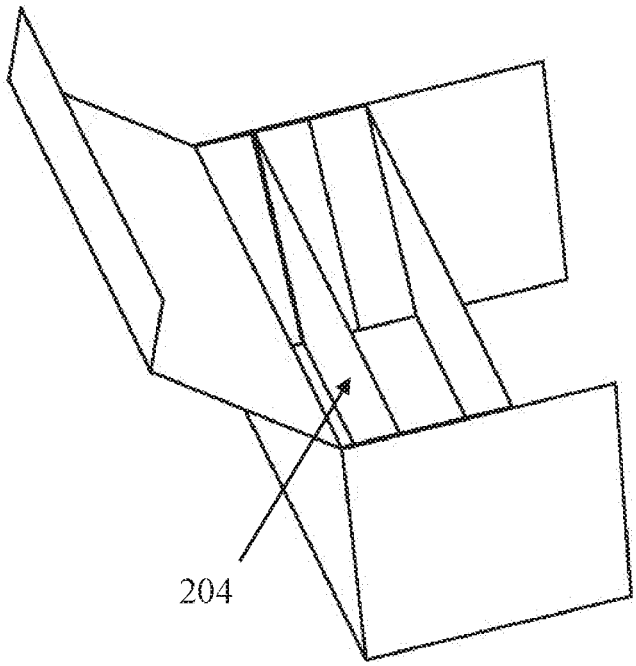
FIG. 2C is a schematic illustration of a collapsible structure with multiple opposite foldable support panels and tab panels, according to some embodiments of the present invention.

Optionally, the collapsible structure includes a ground support panel 202, as shown at FIG. 2B. Ground support panel 202 is connected to cross panel 201 via a ground support cross folding line 212 which is perpendicular to cross folding line 211. When collapsible structure 100 is in an erected position, ground support panel 202 is perpendicular to cross panel 201 and the ground to provide more structural strength.

The collapsible structure may also include any number of extra support panel(s) 204, as shown at FIG. 1C. The extra support panel(s) provide more structural strength.

Figure 2D:
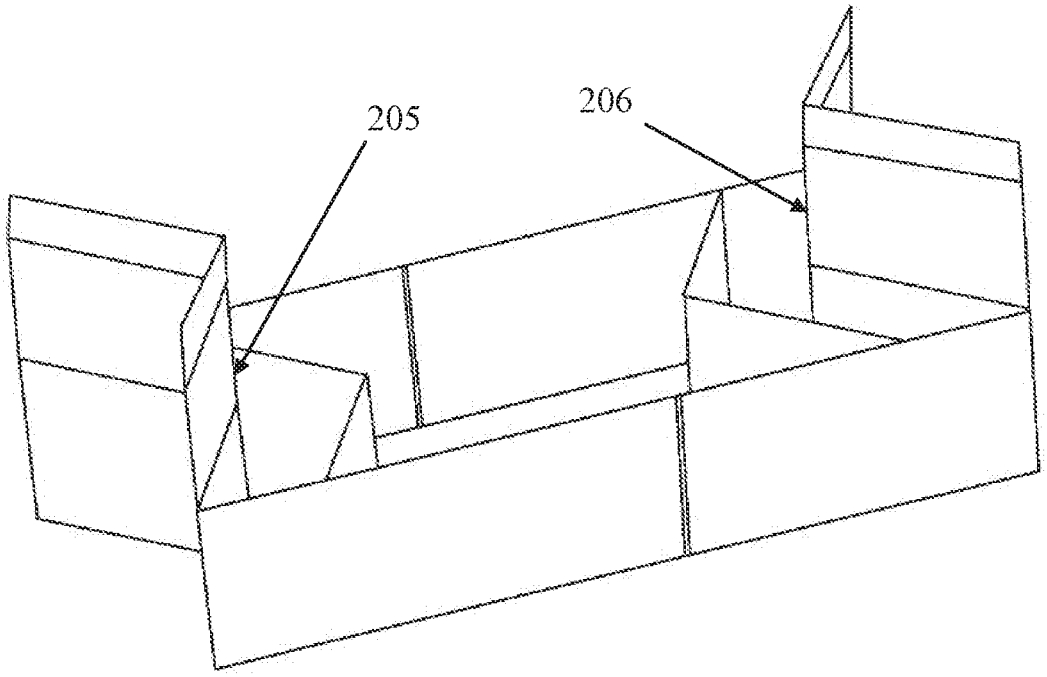
FIG. 2D is a schematic illustration of a collapsible structure with opposite support panels and tab panels, according to some embodiments of the present invention.

Optionally, as shown at FIG. 2D, support panels 103 and 104 may each include a longitudinal folding line 205 and 206 perpendicular to internal folding lines 115 and 116. When collapsible structure 100 is in a collapsed position, support panels 103 and 104 are folded by longitudinal folding line 205 and 206. The foldable support panels may fold in any way, using any pattern of longitudinal folding lines. For example, the foldable support panels may fold by three parallel folding lines.

Optionally, the structure is made by one sheet of material, as described above.

Figure 3:
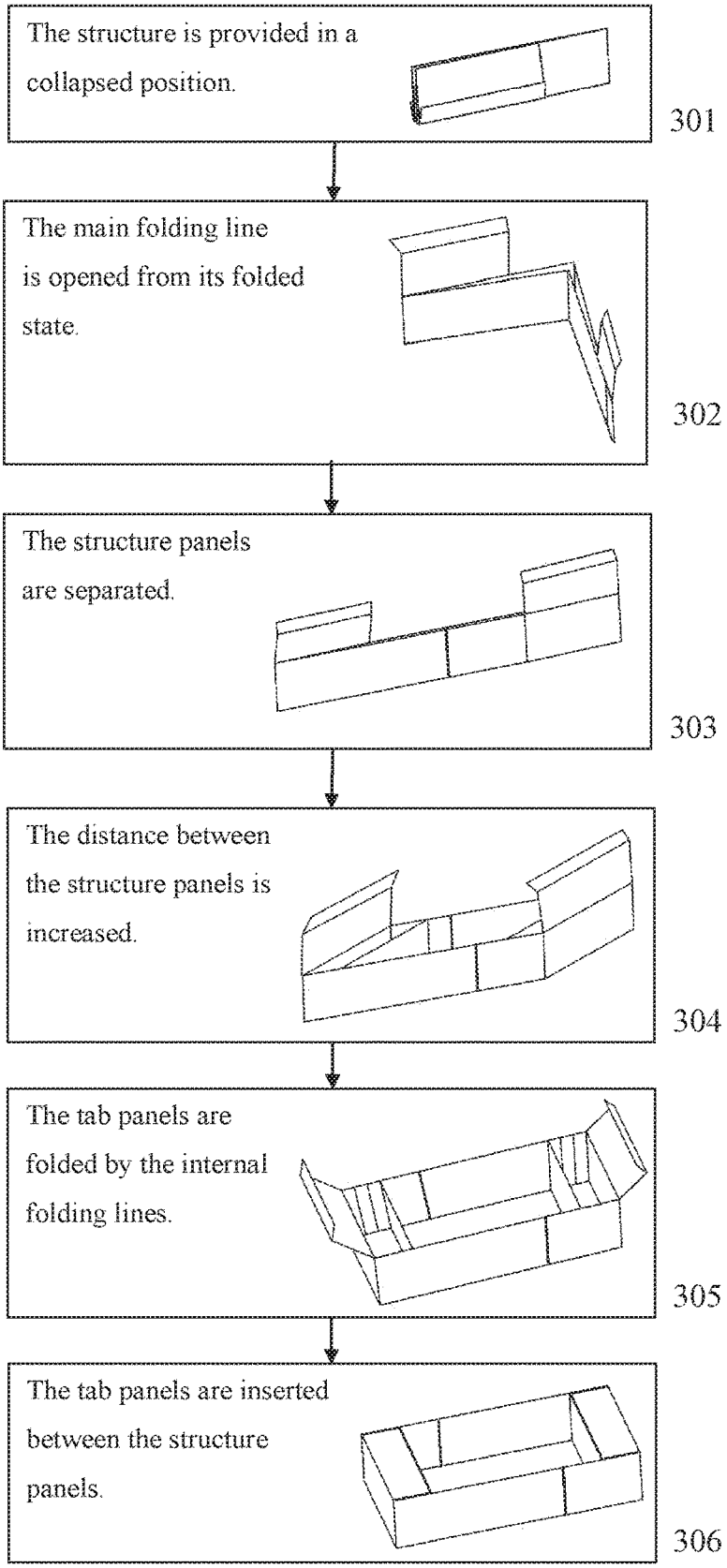
FIG. 3 is a flowchart schematically representing a method for erecting the collapsible structure of FIGS. 1A-G, according to some embodiments of the present invention.

Reference is now made to FIG. 3, which is a flowchart schematically representing a method for erecting the collapsible structure of FIGS. 1A-G, according to some embodiments of the present invention.

First, as shown at 301, collapsible structure 100 is provided in a collapsed position. In this position, first structure panel 101 and second structure panel 102 are adjacent and folded. Optionally, tab panels 105 and 106 are also folded.

Then, as shown at 302, the main folding line is opened from its folded state and structure panels 101 and 102 are unfolded. Optionally, tab panels 105 and 106 are also unfolded.

Then, as shown at 303, first structure panel 101 and second structure panel 102 are separated.

Then, as shown at 304, the distance between first structure panel 101 and second structure panel 102 is increased. In the maximal distance between first structure panel 101 and second structure panel 102, support panels 103 and 104 are perpendicular to structure panels 101 and 102.

Then, as shown at 305, tab panels 105 and 106 are folded by internal folding lines 115 and 116.

Finally, as shown at 306, tab panels 105 and 106 are inserted between first structure panel 101 and second structure panel 102 to support a rigid distance between them.

Figure 4A:
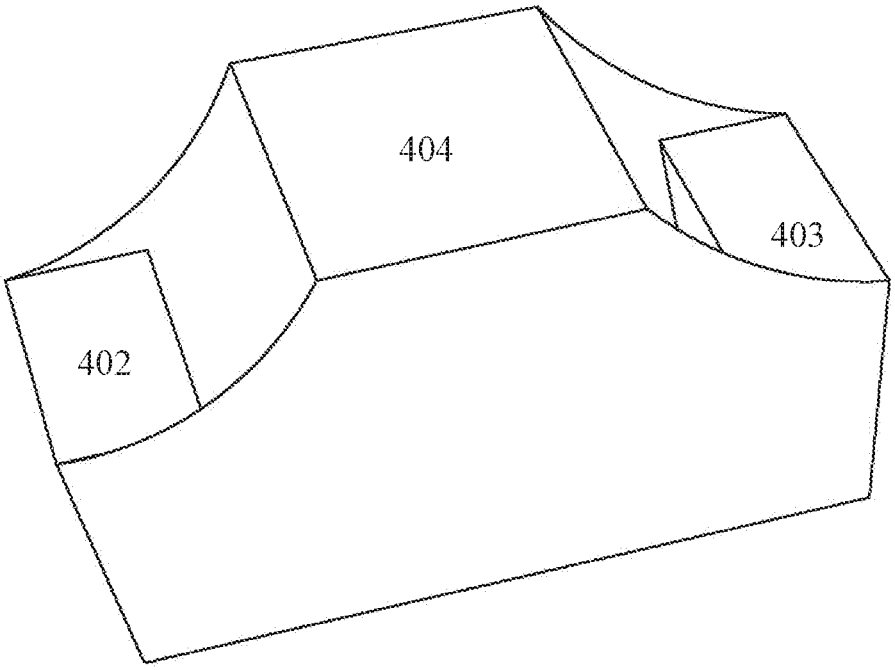
FIG. 4A and FIG. 4B are schematic illustrations of an exemplary collapsible cardboard play table, according to some embodiments of the present invention.
Figure 4B:
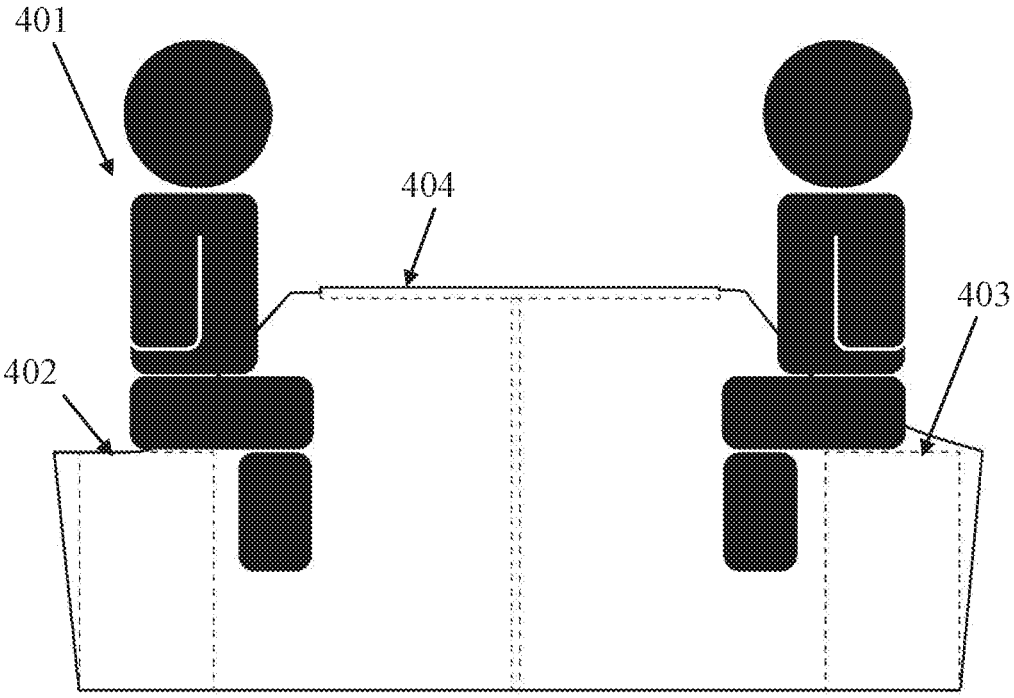
Figure 4C:
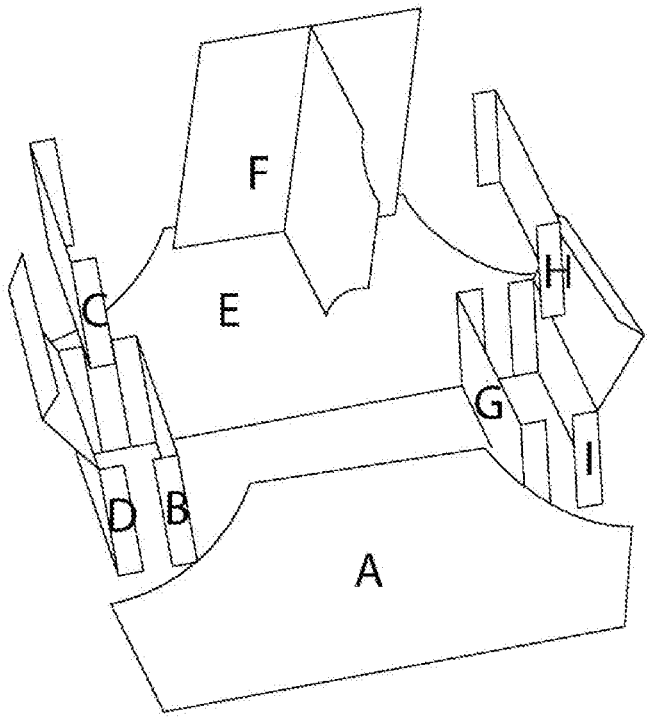
FIG. 4C is a schematic illustration of a process of building the collapsible cardboard play table of FIG. 9A and the spread parts of the collapsible cardboard play table of FIG. 9A, according to some embodiments of the present invention.
Figure 4C:
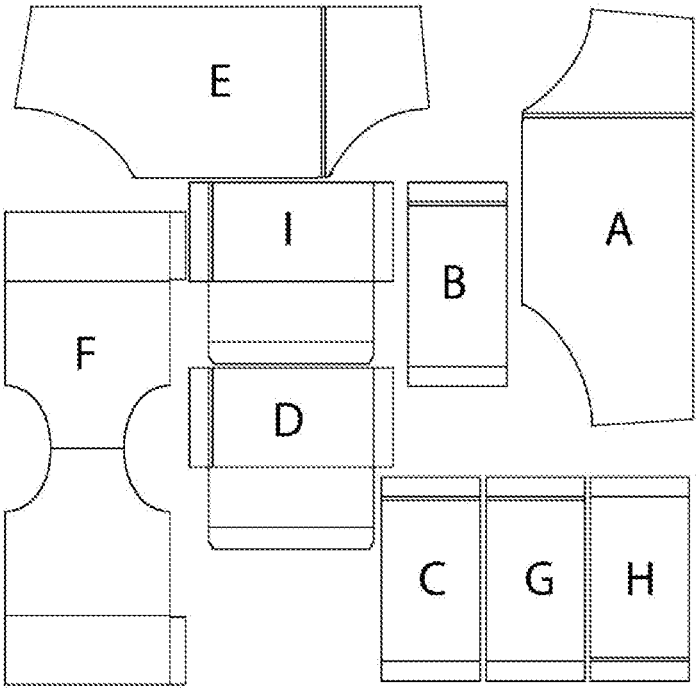

Reference is now made to FIG. 4A and FIG. 4B, which are a schematic illustrations of an exemplary collapsible cardboard play table, according to some embodiments of the present invention. The structure is made so a child 401 may use tab panels 402 and 403 as a seats. Cross panel 404 is used as a table. Tab panels 402 and 403 are rolled into place when erecting the structure. Reference is also made to FIG. 4C which is a schematic illustration of a process of building the collapsible cardboard play table of FIG. 4A and the spread parts of the collapsible cardboard play table of FIG. 4A, according to some embodiments of the present invention. Optionally, the structure is made by one sheet of material, for example, by plastic injection, as described above. After the construction of the structure, it stays in one piece and may be folded and erected easily.

Reference is now made to FIGS. 5A, 5B, 5C, 5D and 5E, which are schematic illustrations of a collapsible structure with crossing tab panels at different collapsing states, according to some embodiments of the present invention.

The collapsible structure 500 contains a first structure panel 501 and a second structure panel 502. Collapsible structure 500 also contains at least two support panels 503 and 504 each connected to first structure panel 501 and second structure panel 502 via two support folding lines, optionally parallel, at opposite sides of the foldable support panel, such as 511 and 512. Collapsible structure 500 also contains at least two foldable tab panels 505 and 506 connected to structure panels 501 and 502 at an upper side via tab folding lines 513 and 514, perpendicular to support folding lines 511 and 512. Tab panels 505 and 506 contain at least one internal folding line such as 515 and 516 parallel to tab folding lines 513 and 514.

Figure 5A:
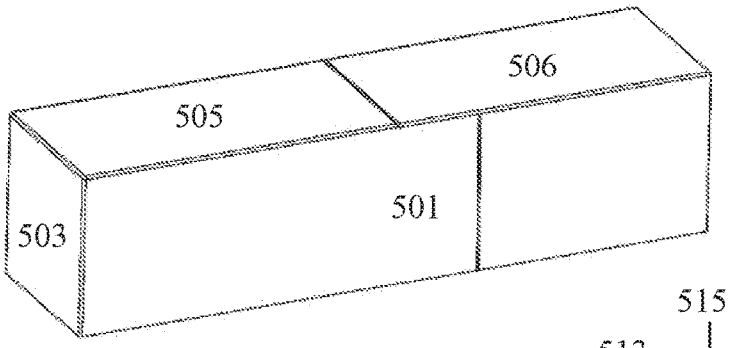
FIGS. 5A, 5B, 5C, 5D and 5E are schematic illustrations of a collapsible structure with crossing tab panels at different collapsing states, according to some embodiments of the present invention.
Figure 5B:
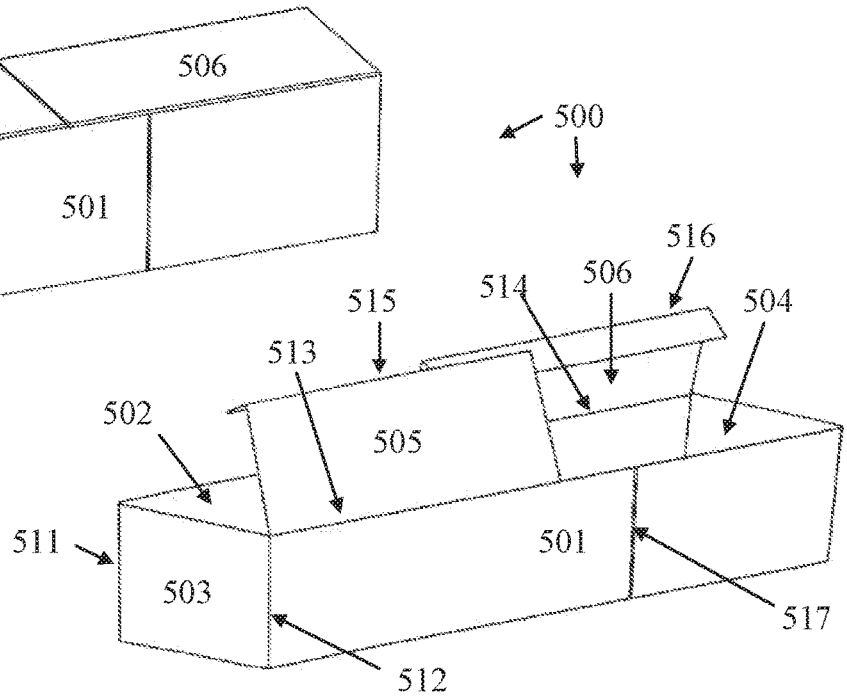
Figure 5C:
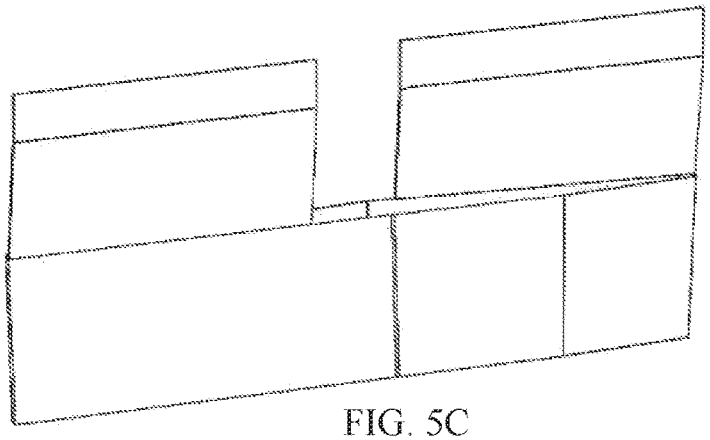
Figure 5D:
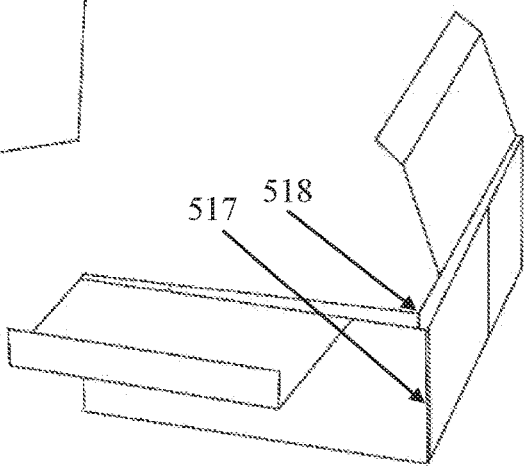
Figure 5E:
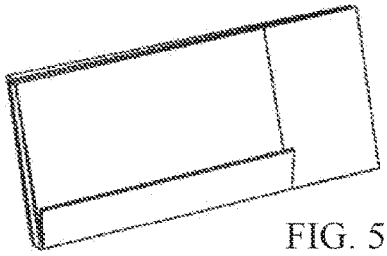

When collapsible structure 500 is in a collapsed position, as shown at FIG. 5E, panels 501-506 are adjacent and generally parallel to each other, while structure panels 501 and 502 are folded along a main folding line, for example made by divide folding lines 517 and 518. Optionally, structure panels 501 and 502 are folded so the length of the collapsed structure is half the length of a structure panel and a support panel. Optionally, tab panels 505 and 506 are folded by tab folding lines 513 and 514 and/or internal folding lines 515 and 516.

When collapsible structure 500 is in an erected position, as shown at FIG. 5A, structure panels 501 and 502 are straightened and tab panels 505 and 506 are folded by tab folding lines 513 and 514 and internal folding lines 515 and 516. Each of tab panels 506 and 506 is partially adjacent to an opposing structure panel.

Reference is now made to FIGS. 6A, 6B, 6C and 6D, which are schematic illustrations of exemplary collapsible structures with crossing tab panels, according to some embodiments of the present invention.

Figure 6A:
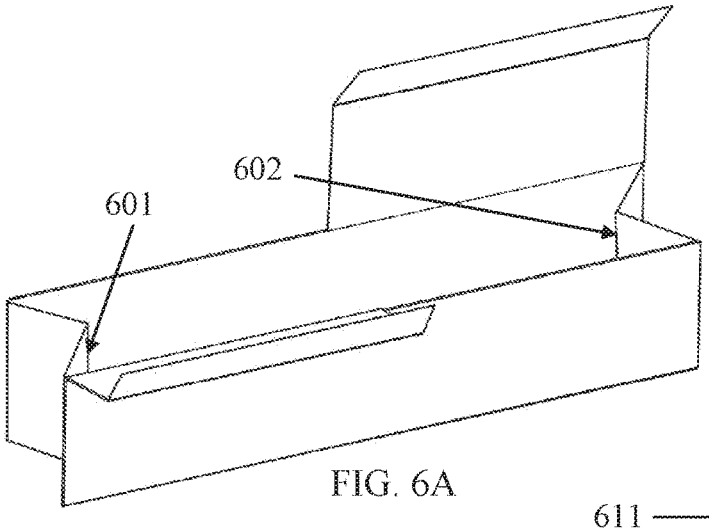
FIGS. 6A, 6B, 6C and 6D are schematic illustrations of exemplary collapsible structures with crossing tab panels, according to some embodiments of the present invention.

Optionally, as shown at FIG. 6A, support panels 503 and 504 may each include a longitudinal folding line 601 and 602 perpendicular to internal folding lines 515 and 516. When collapsible structure 500 is in a collapsed position, support panels 503 and 504 are folded by longitudinal folding line 601 and 602. The foldable support panels may fold in any way, using any pattern of longitudinal folding lines. For example, the foldable support panels may fold by three parallel folding lines.

Figure 6B:
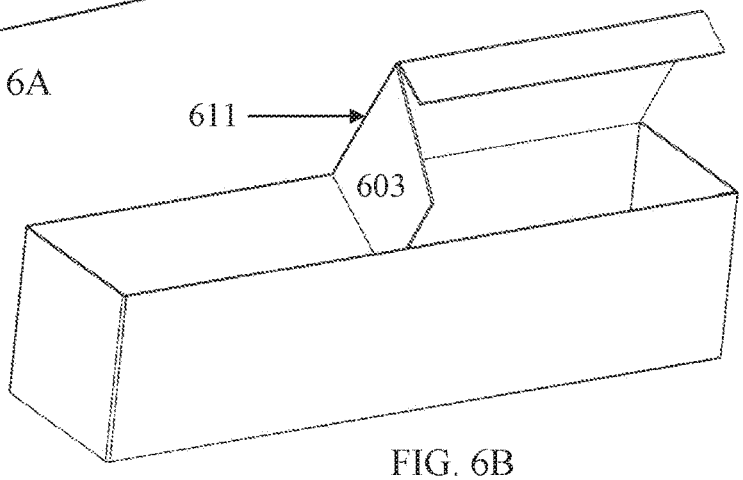

Optionally, the structure include a cross panel 603, as shown at FIG. 6B. Cross panel 603 may be connected to tab panels 505 or 506 via a cross folding line 611 perpendicular to tab folding lines 513 and 514. When collapsible structure 500 is in an erected position, cross panel 603 is perpendicular the structure panels and adds structural strength.

Figure 6C:
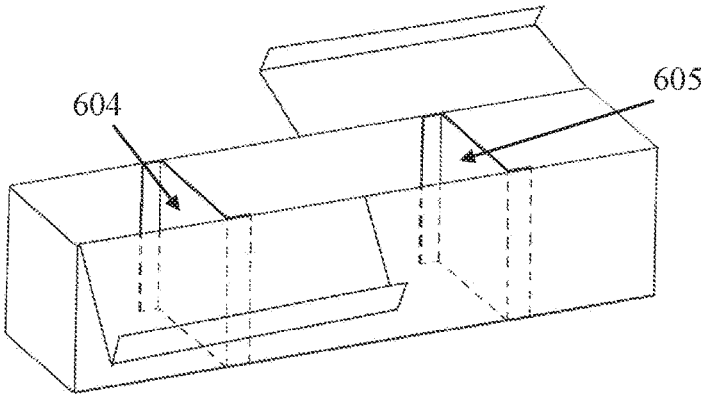

The collapsible structure may also include any number of extra support panel(s) such as 604 and 605, as shown at FIG. 6C. The extra support panel(s) provide more structural strength. Optionally, tab panels 505 and/or 506 include an interlocking slit in which extra support panel(s) 604 and/or 605 are inserted when collapsible structure 500 is in an erected position, for reinforcement.

Figure 6D:
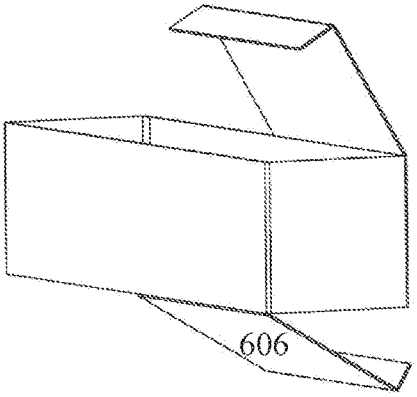

The collapsible structure may also include any number of extra tab panel(s) such as 606, as shown at FIG. 6D. The extra tab panel(s) may be connected to structure panels 501 and 502 at bottom side. The extra tab panel(s) may provide more structural strength and/or be used as a bottom of the structure to allow storage inside the structure.

Optionally, the structure is made by one sheet of material, as described above.

Figure 7:
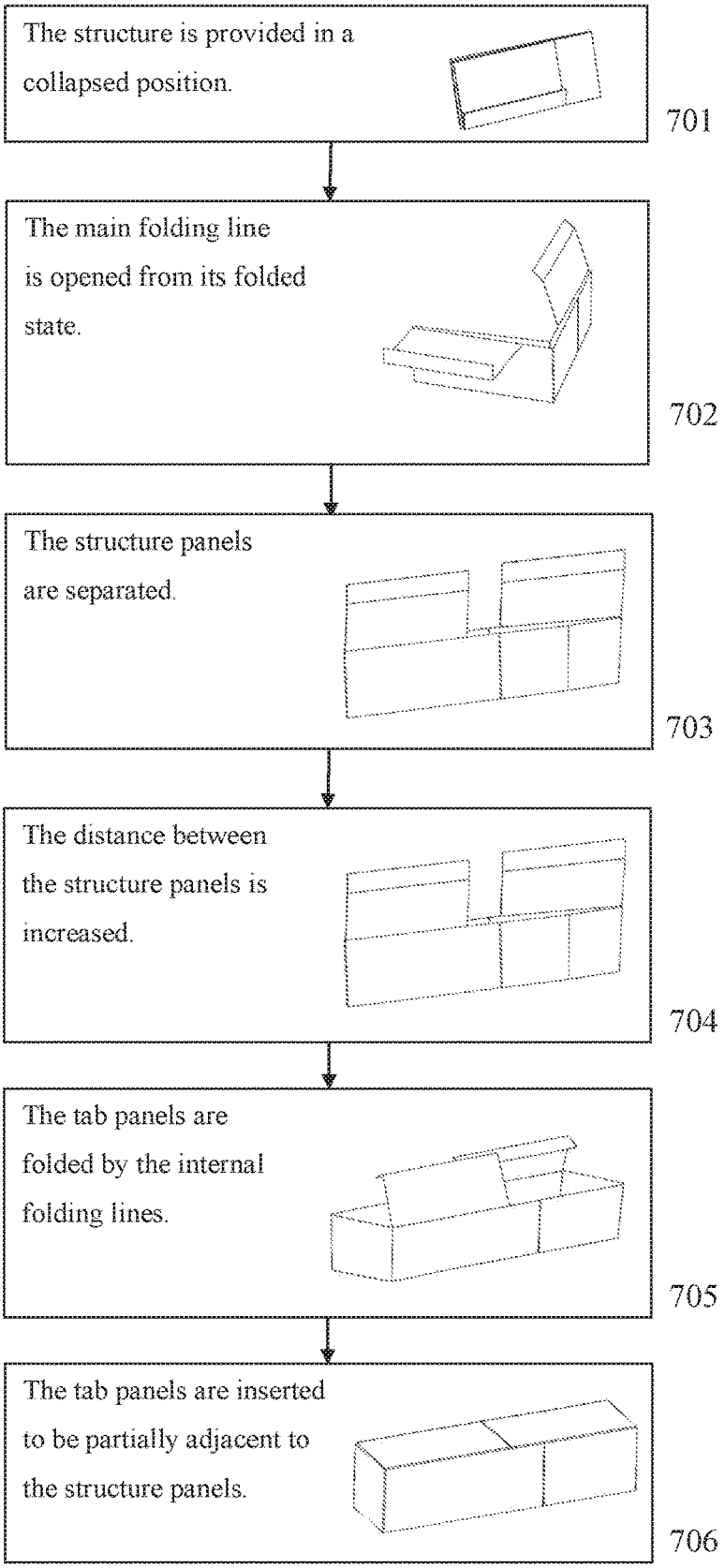
FIG. 7 is a flowchart schematically representing a method for erecting the collapsible structure of FIGS. 5A-E, according to some embodiments of the present invention.

Reference is now made to FIG. 7, which is a flowchart schematically representing a method for erecting the collapsible structure of FIGS. 5A-E, according to some embodiments of the present invention.

First, as shown at 701, collapsible structure 500 is provided in a collapsed position. In this position, first structure panel 501 and second structure panel 502 are adjacent and folded. Optionally, tab panels 505 and 506 are also folded.

Then, as shown at 702, the main folding line is opened from its folded state and structure panels 501 and 502 are unfolded. Optionally, tab panels 505 and 506 are also unfolded.

Then, as shown at 703, first structure panel 501 and second structure panel 502 are separated.

Then, as shown at 704, the distance between first structure panel 501 and second structure panel 502 is increased. In the maximal distance between first structure panel 501 and second structure panel 502, support panels 503 and 504 are perpendicular to structure panels 501 and 502.

Then, as shown at 705, tab panels 505 and 506 are folded by tab folding lines 513 and 514 and internal folding lines 515 and 516.

Finally, as shown at 706, tab panels 505 and 506 are inserted to be partially adjacent to an opposing structure panel 101 or 102 to support a rigid distance between them.

Figure 8A:
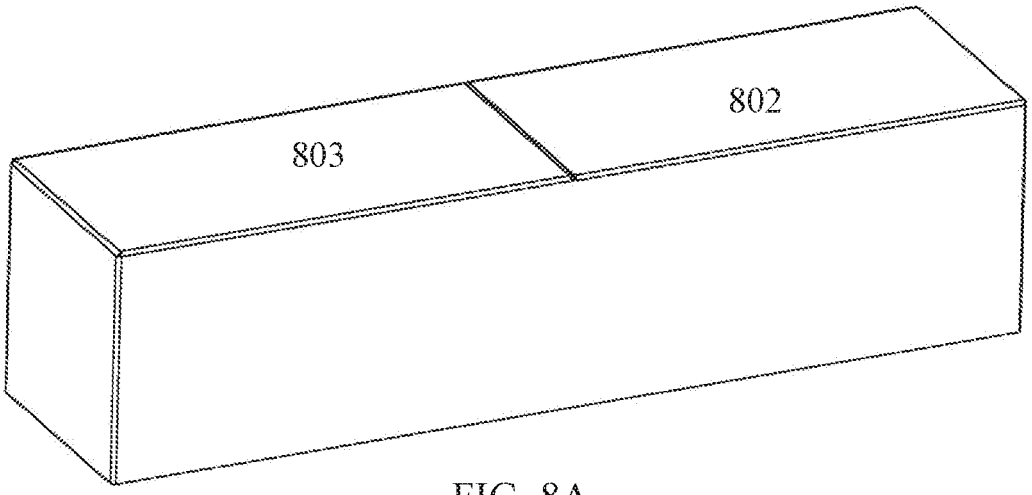
FIGS. 8A, 8B and 8C are a schematic illustrations of an exemplary collapsible cardboard play sitting storage structure with crossing tab panels, according to some embodiments of the present invention.
Figure 8B:
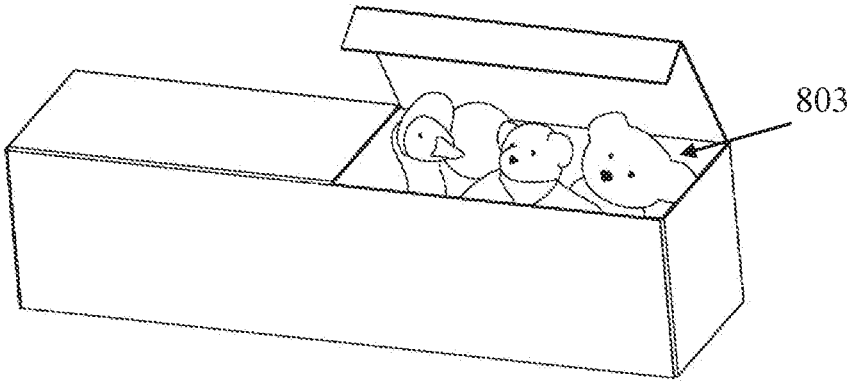
Figure 8C:
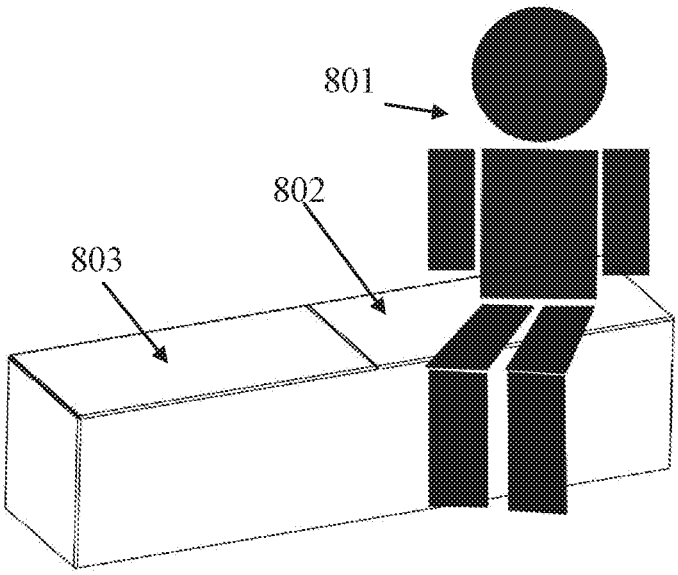
Figure 8D:
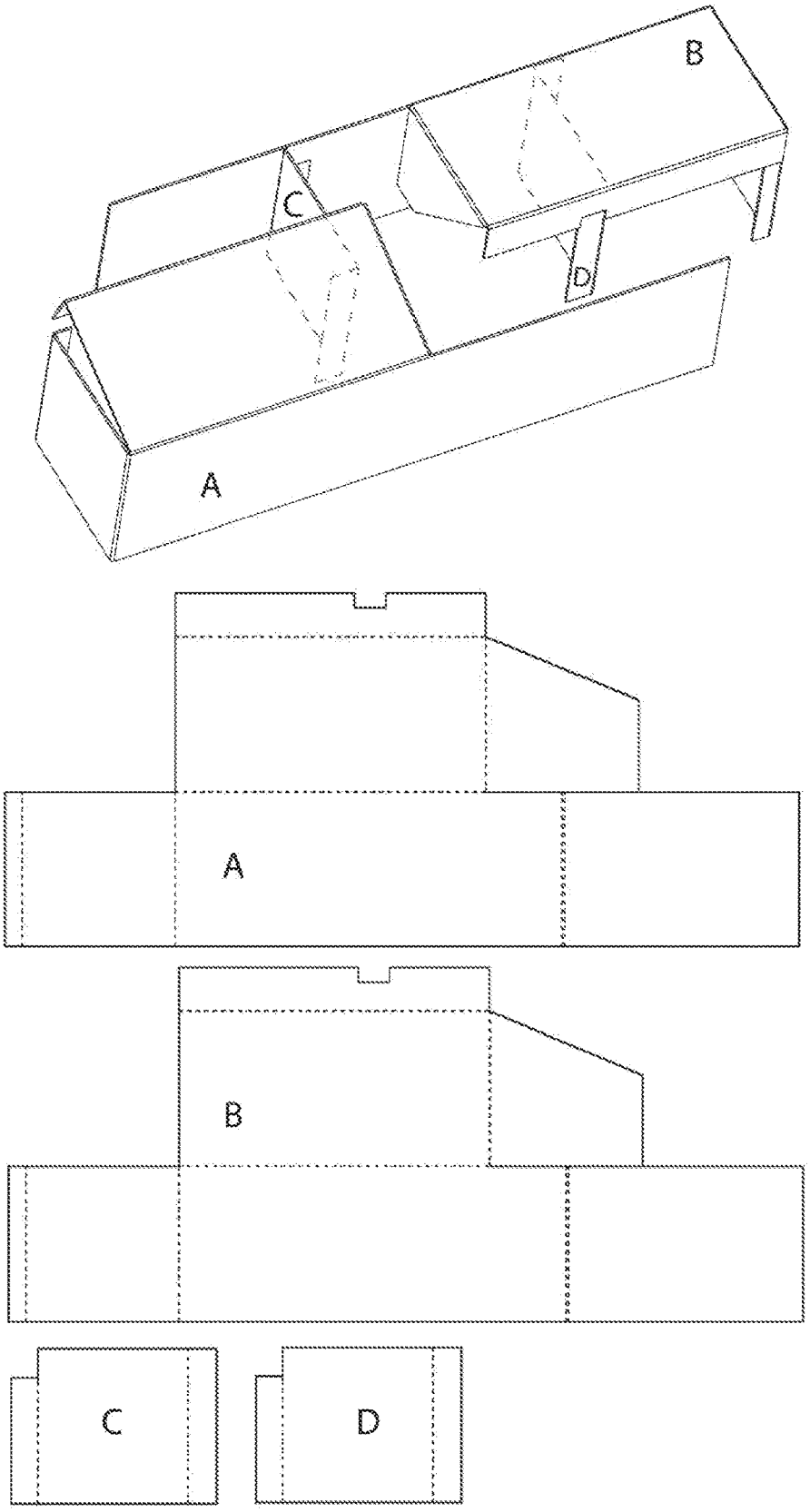
FIG. 8D is a schematic illustration of a process of building the cardboard play sitting storage structure of FIG. 8A and the spread parts of the cardboard play sitting storage structure of FIG. 8A, according to some embodiments of the present invention.

Reference is now made to FIGS. 8A, 8B and 8C are a schematic illustrations of an exemplary collapsible cardboard play sitting storage structure with crossing tab panels, according to some embodiments of the present invention. The structure is made so a child 801 may use tab panels 802 and 803 as a seats. Tab panels 802 and 803 may be opened in order to store items 804 inside the structure, as shown at FIG. 8B. Reference is also made to FIG. 8D is a schematic illustration of a process of building the cardboard play sitting storage structure of FIG. 8A and the spread parts of the cardboard play sitting storage structure of FIG. 8A, according to some embodiments of the present invention. Optionally, the structure is made by one sheet of material, for example, by plastic injection, as described above. After the construction of the structure, it stays in one piece and may be folded and erected easily.

Reference is now made to FIGS. 9A, 9B, 9C, 9D and 9E, which are schematic illustrations of a collapsible structure with parallel cells, according to some embodiments of the present invention.

The collapsible structure 900 contains a first structure panel 901 and a second structure panel 902. Collapsible structure 900 also contains a first outer support panel 903, a second outer support panel 904 and a middle support panel 905, each connected to first structure panel 901 and second structure panel 902 via two support folding lines, optionally parallel, at opposite sides of the foldable support panel, such as 911 and 912. Collapsible structure 900 also contains a first inner support panel 906 and a second inner support panel 906. Collapsible structure 900 also contains at least two foldable panels connected to middle support panel 905 and to one or more of first and second inner support panels 906 and 907.

Optionally, the foldable panels include a top foldable panel 908 and a bottom foldable panel 909. Each of foldable panels 908 and 909 is connected to middle support panel 905 via an internal folding line 913 in the middle of the foldable panel, and connected to first and second inner support panels 906 and 907 via two inner support folding lines 914, 915 at opposite sides of the foldable panel.

Figure 9A:
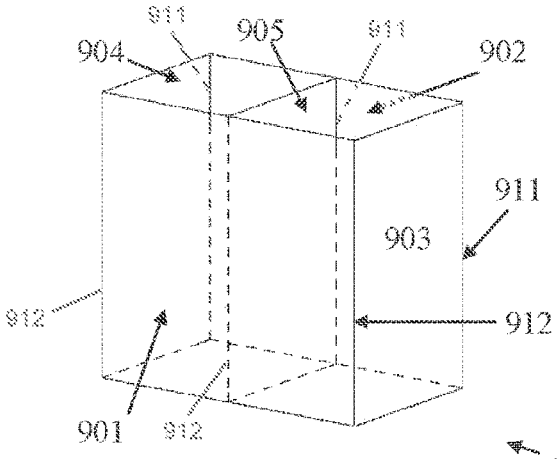
FIGS. 9A, 9B, 9C, 9D and 9E are schematic illustrations of a collapsible structure with parallel cells at different collapsing states, according to some embodiments of the present invention.
Figure 9B:
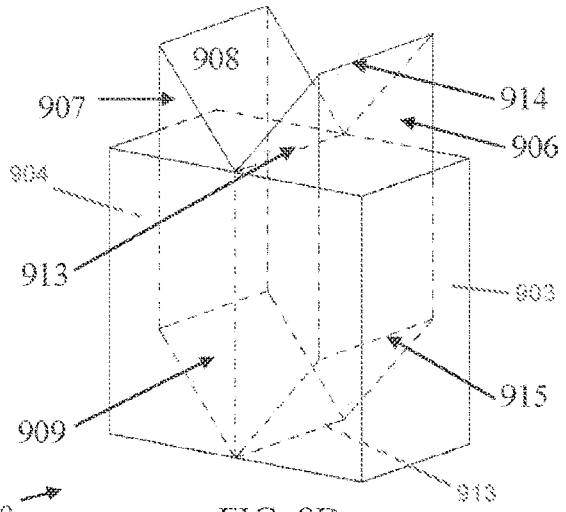
Figure 9C:
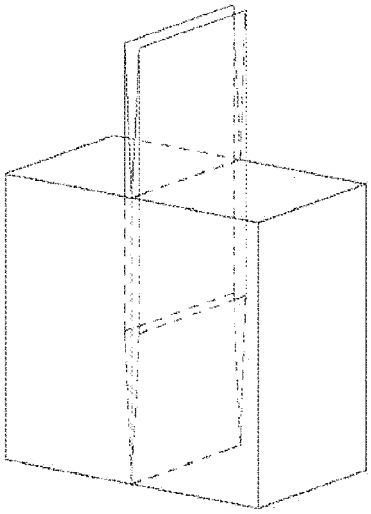
Figure 9D:
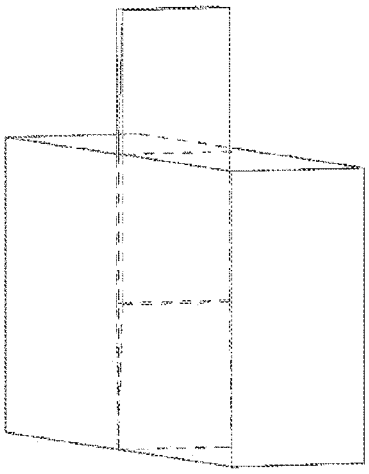
Figure 9E:
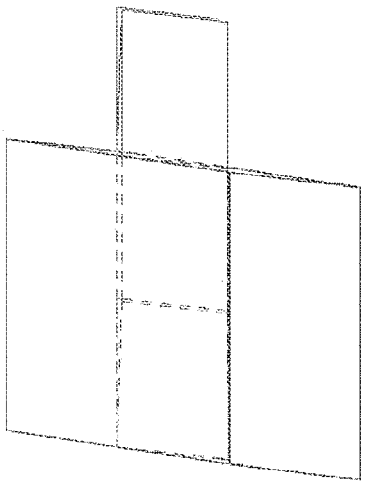

When collapsible structure 900 is in a collapsed position, as shown at FIG. 9E, panels 901-909 are adjacent and generally parallel to each other. Optionally, foldable panels 908 and 909 by folded by internal folding line(s) 913.

When collapsible structure 900 is in an erected position, as shown at FIG. 9A, support panels 903-907 are perpendicular to structure panels 901 and 902. First inner support panel 906 is adjacent to first outer support panel 903 and second 907 is adjacent to second outer support panel 904. Optionally, top foldable panel 908 and bottom foldable panel 909 are unfolded.

Reference is now made to FIGS. 10A, 10B, 10C, 10D and 10E, which are schematic illustrations of exemplary collapsible structures some of which being with parallel cells, when each shown cell may be seen at different collapsing states, according to some embodiments of the present invention.

Figure 10A:
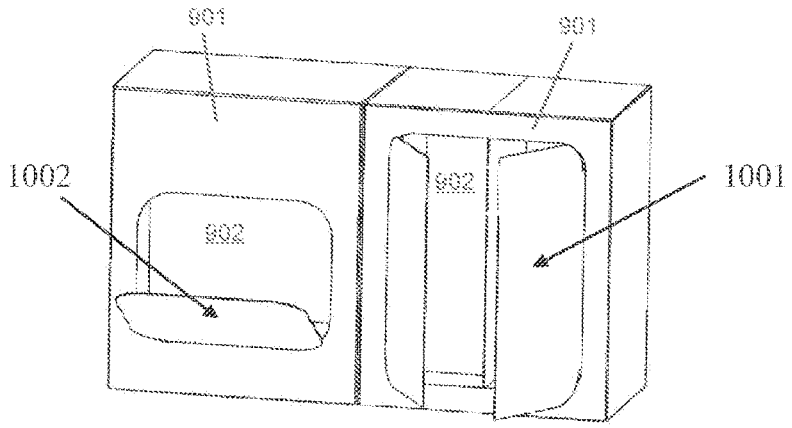
FIGS. 10A, 10B, 10C, 10D and 10E are schematic illustrations of exemplary collapsible structures with parallel cells, according to some embodiments of the present invention.

Optionally, first structure panel 901 and/or second structure panel 902 include one or more cuts to create one or more opening(s) to said structure, as shown at FIG. 10A that exhibits a structure(s) with parallel cells. The cuts may create a flap of the structure panel to be used as a door, such as doors 1001 and 1002.

Figure 10B:
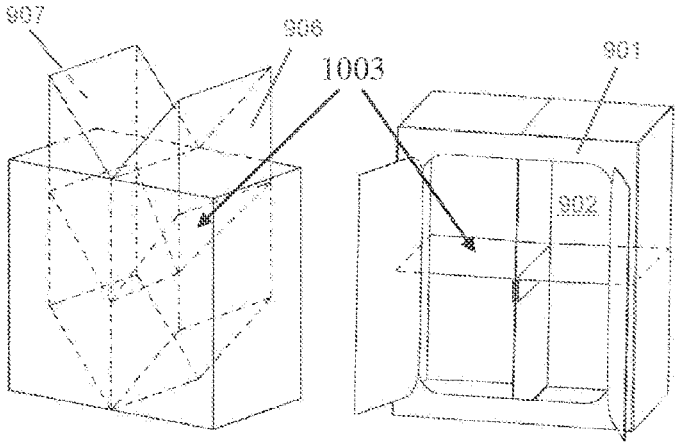

Optionally, the collapsible structure includes one or more intermediate panel(s) 1003 connected to auxiliary support panel 905 and one of the inner support panels 906 or 907, as shown at FIG. 10B that exhibits a structure with parallel cells. Intermediate panel(s) 1003 may be horizontal and used as one or more shelves inside the structure.

Figure 10C:
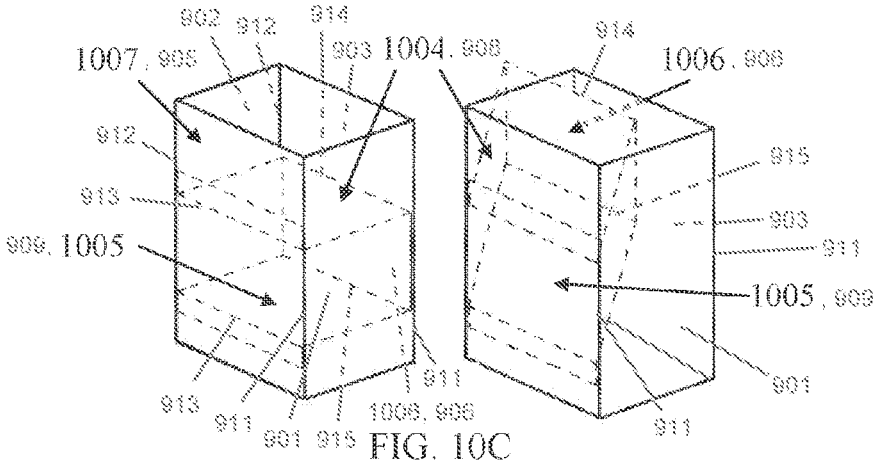

Optionally as seen in FIG. 10C that exhibits a single cell structure, two foldable panels 1004, 908 and 1005, 909 and one inner support panel 1006, 906 are included in one panel having two folding lines 914, 915 each connecting one of said foldable panels to said inner support panel. The panel is connected to an auxiliary support panel 1007 via two folding lines 913 at opposite sides of the panel.

Figure 10D:
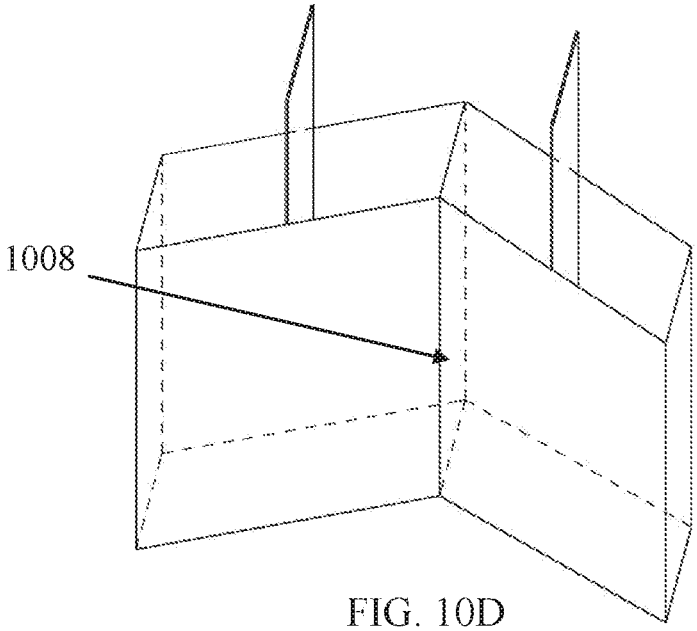
Figure 10E:
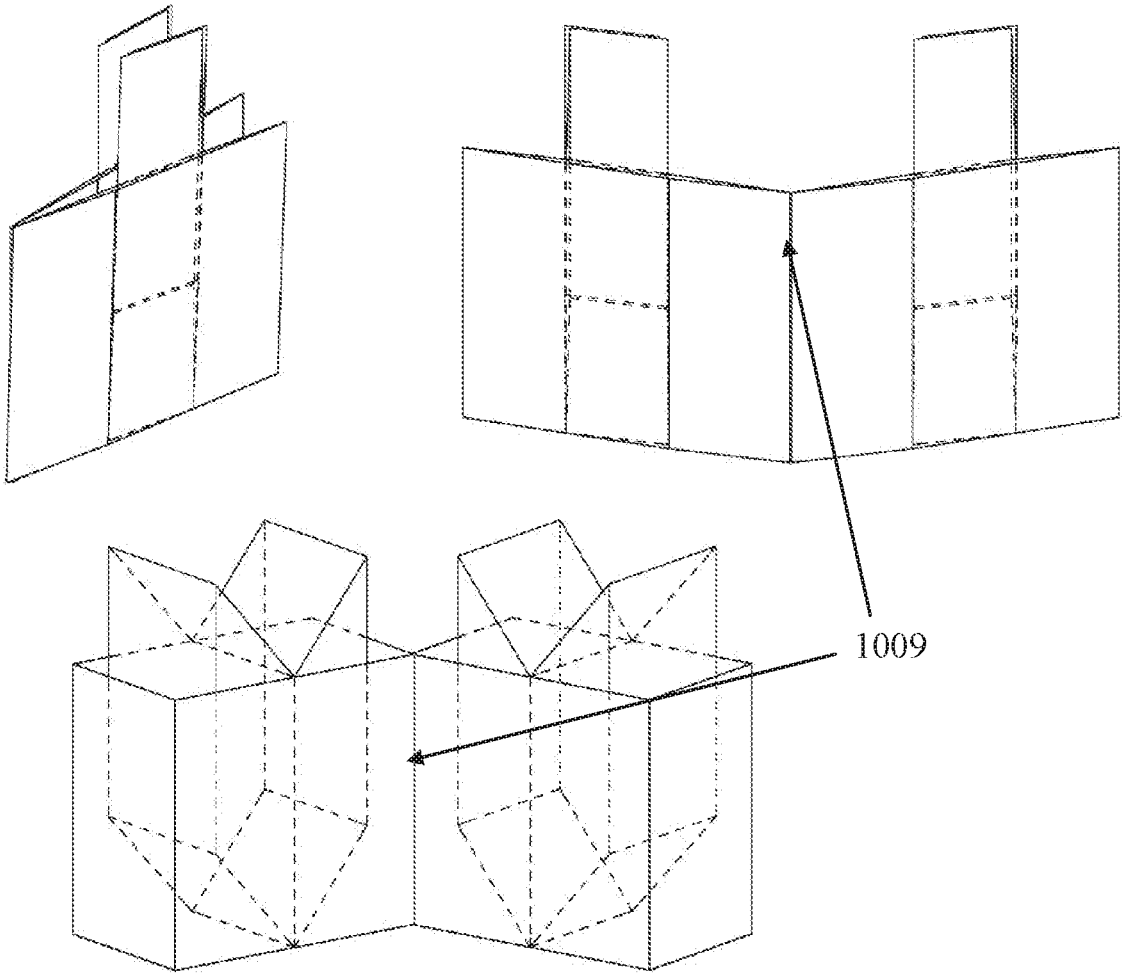

Optionally, two or more units of collapsible structure 900 may be connected. For example, the units may be connected by a mutual outer support panel 1008, as shown at FIG. 10D. For example, the units may be connected via a support folding line 1009 of each of the units, as shown at FIG. 10E.

Optionally, the structure is made by one sheet of material, as described above.

Figure 11:
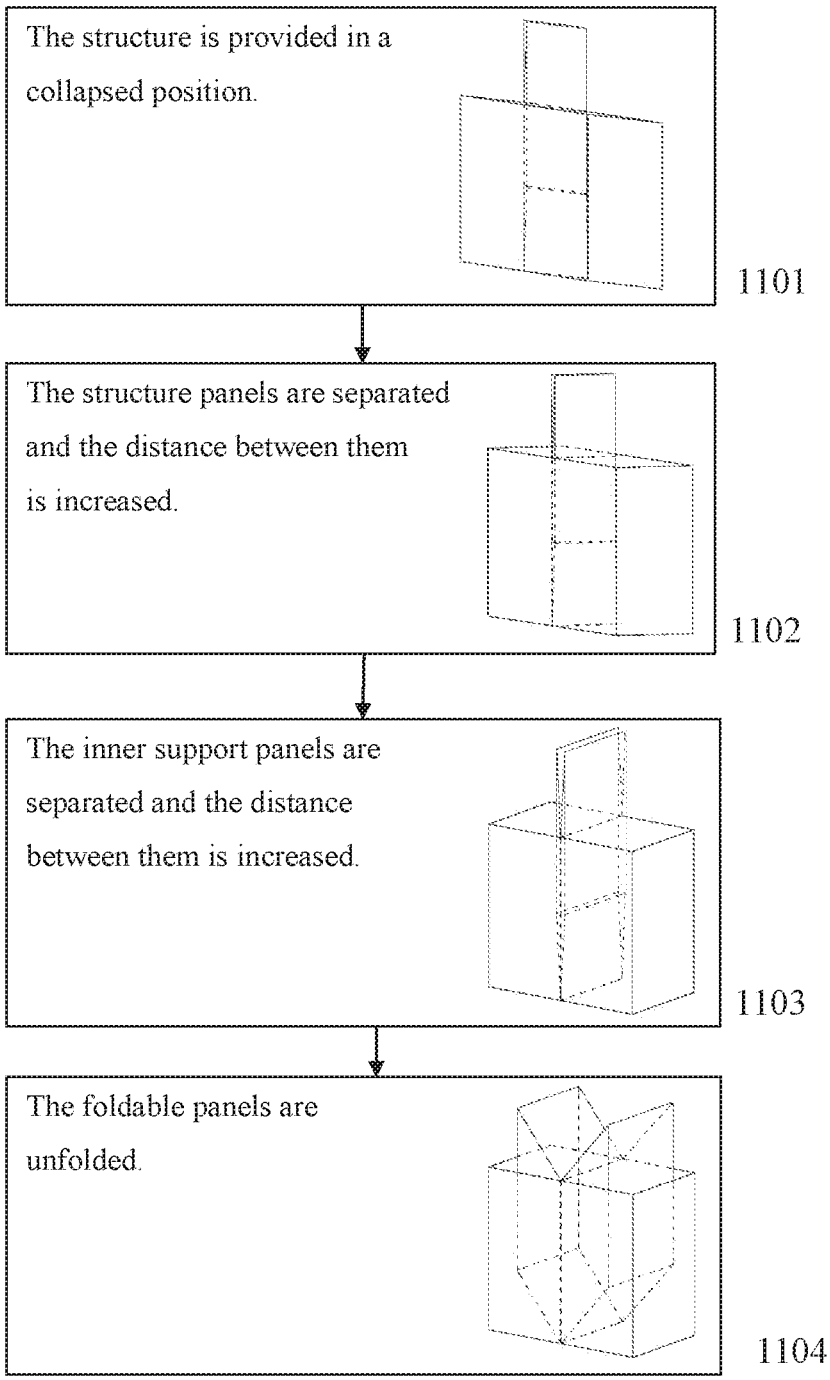
FIG. 11 is a flowchart schematically representing a method for folding the collapsible structure of FIGS. 9A-E, according to some embodiments of the present invention.

Reference is now made to FIG. 11, which is a flowchart schematically representing a method for folding the collapsible structure of FIGS. 9A-E, according to some embodiments of the present invention.

First, as shown at 1101, collapsible structure 900 is provided in a collapsed position.

Then, as shown at 1102, first structure panel 901 and second structure panel 902 are separated and the distance between them is increased. In the maximal distance between first structure panel 901 and second structure panel 902, support panels 903-907 are perpendicular to structure panels 901 and 902.

Then, as shown at 1103, first inner support panel 906 and middle support panel 905 are separated and second inner support panel 907 and middle support panel 905 are separated and the distance between all these panels is increased.

Finally, as shown at 1104, top foldable panel 908 and a bottom foldable panel 909 are unfolded to support a rigid distance between first structure panel 901 and second structure panel 902

Figure 12A:
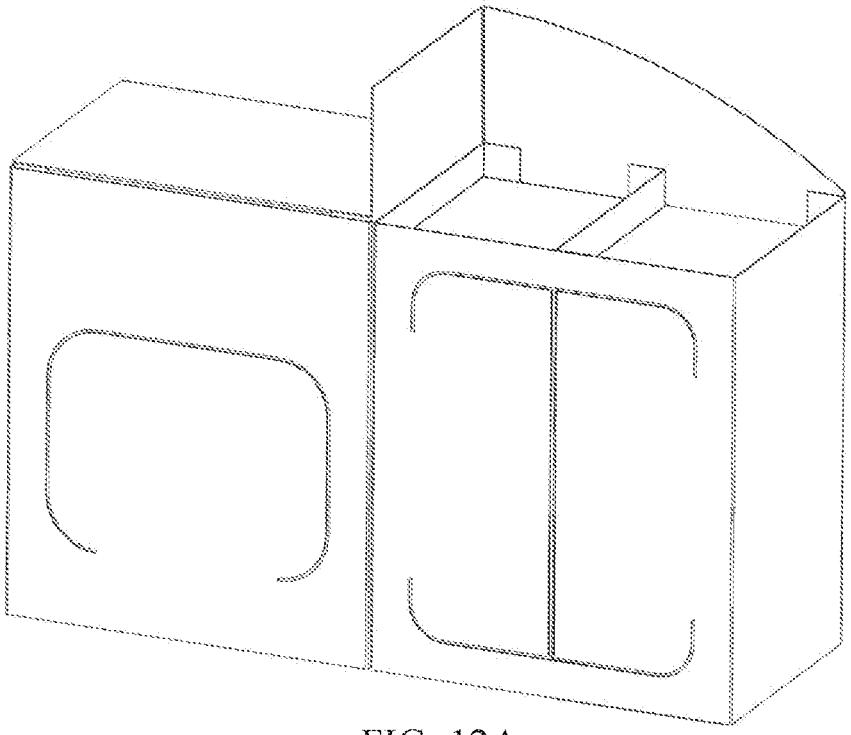
FIGS. 12A and 12B are schematic illustrations of an exemplary collapsible cardboard play kitchen structure with interlocking slit, according to some embodiments of the present invention.
Figure 12B:
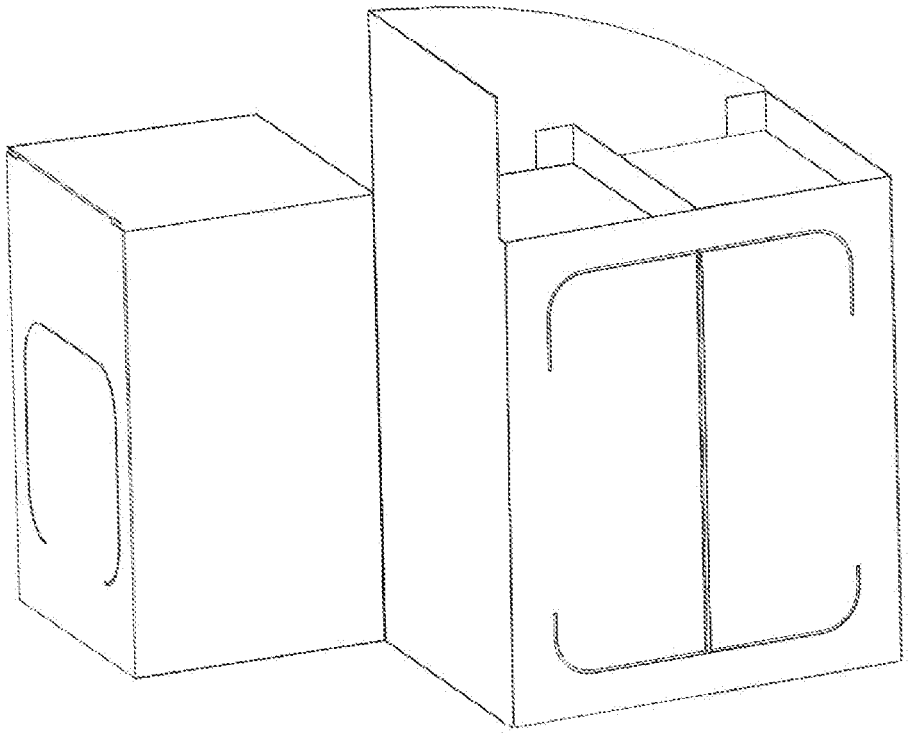
Figure 12C:
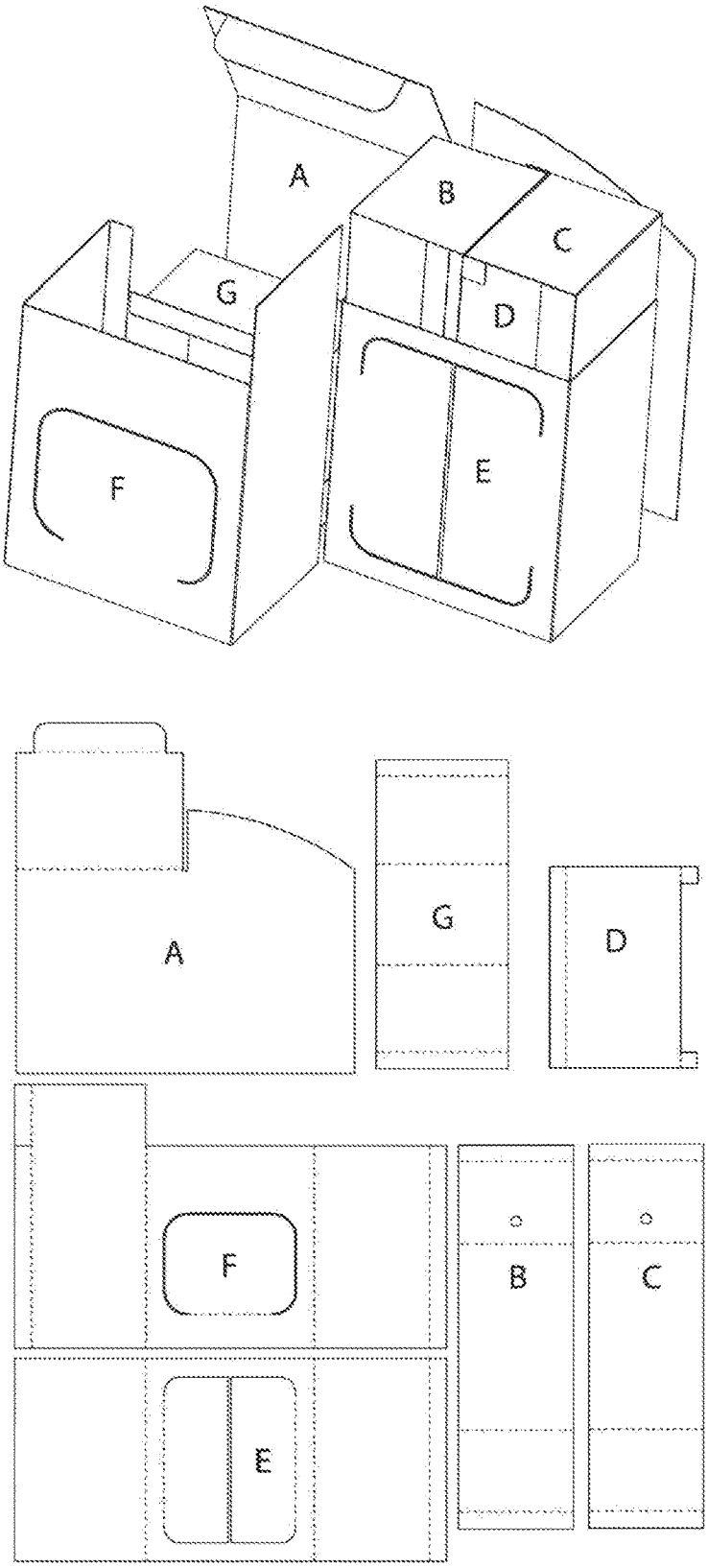
FIG. 12C is a schematic illustration of the spread parts of the cardboard play kitchen structure of FIG. 12A and its construction, according to some embodiments of the present invention.

Reference is now made to FIGS. 12A and 12B, which are schematic illustrations of an exemplary collapsible cardboard play kitchen structure with interlocking slit, according to some embodiments of the present invention. Reference is also made to FIG. 12C, which is a schematic illustration of the spread parts of the cardboard play kitchen structure of FIG. 12A and its construction, according to some embodiments of the present invention. Optionally, the structure is made by one sheet of material, for example, by plastic injection, as described above. After the construction of the structure, it stays in one piece and may be folded and erected easily.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant collapsible structures will be developed and the scope of the term collapsible structure is intended to include all such new technologies a priori.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A collapsible structure with at least one cell, the at least one cell comprising:

first and second structure panels (901, 902);

at least one outer support panel (903, 904) and an auxiliary support panel (1007, 905), each one of said outer (903, 904) and auxiliary (1007, 905) support panels is connected to said first and second structure panels (901, 902) via two support folding lines (911, 912) at its opposite sides;

at least one inner support panel (1006, 906, 907); and at least two foldable panels (1004, 908, 1005, 909), each one of said at least two foldable panels is connected to said auxiliary support panel (1007, 905) and connected to the at least one inner support panel (1006, 906, 907) at opposite sides of said each one of said at least two foldable panels;

wherein when said structure is in a collapsed position, the structure panels (901, 902), the auxiliary support panel (1007, 905) and the at least one outer support panel (903, 904) are adjacent and generally parallel to each other; and wherein when said structure is in an erected position, the auxiliary support panel (1007, 905) is perpendicular to said first and second structure panels (901, 902) and the at least one inner support panel (1006, 906, 907) is adjacent to the at least one outer support panel (903, 904).

2. The collapsible structure of claim 1, wherein said at least two foldable panels (1004, 908, 1005, 909) include a top foldable panel (1004, 908) and a bottom foldable panel (1005, 909), each of said foldable panels is connected to said auxiliary support panel via an internal folding line (913), and connected to said at least one inner support panel (1006, 906, 907) via a folding line (914, 915) at an opposite side of said foldable panel.

3. The collapsible structure of claim 2, wherein when said structure is in a collapsed position said top and bottom foldable panels (1004, 908, 1005, 909) are folded by said internal folding lines (913), and when said structure is in an erected position said top and bottom foldable panels (1004, 908, 1005, 909) are unfolded.

4. The collapsible structure of claim 1, wherein when said structure is in an erected position the at least one outer support panel (903, 904) and the auxiliary support panel (1007, 905) are generally parallel to each other.

5. The collapsible structure of claim 4, wherein when said structure is in an erected position said first and second structure panels (901, 902) are generally parallel to each other.

6. A method of manipulating a collapsible structure comprising the steps of:

providing a collapsible structure comprising at least one cell, the at least one cell comprising:

first and second structure panels (901, 902);

at least one outer support panel (903, 904);

an auxiliary support panel (1007, 905);

at least one inner support panel (1006, 906, 907); and at least two foldable panels (1004, 908, 1005, 909); wherein each one of said outer (903, 904) and auxiliary (1007, 905) support panels is connected to said first and second structure panels (901, 902) via two support folding lines (911, 912) at opposite sides of said support panels; and wherein each one of said at least two foldable panels (1004, 908, 1005, 909) is connected to said auxiliary support panel (1007, 905) and to the at least one inner support panel (1006, 906, 907) at its opposite sides;

manipulating the collapsible structure towards a collapsed position where the structure panels (901, 902), the auxiliary support panel (1007, 905) and the at least one outer support panel (903, 904) are adjacent and generally parallel to each other; and manipulating the collapsible structure towards an erected position where the auxiliary support panel (1007, 905) is perpendicular to said first and second structure panels (901, 902) and the at least one inner support panel (1006, 906, 907) is adjacent to the at least one outer support panel (903, 904).

7. The method of claim 6, wherein said at least two foldable panels (1004, 908, 1005, 909) include a top foldable panel (1004, 908) and a bottom foldable panel (1005, 909), each of said foldable panels is connected to said auxiliary support panel via an internal folding line (913), and connected to said at least one inner support panel (1006, 906, 907) via a folding line (914, 915) at an opposite side of said foldable panel.

8. The method of claim 7, wherein when said structure is in a collapsed position said top and bottom foldable panels (1004, 908, 1005, 909) are folded by said internal folding line (913), and when said structure is in an erected position said top and bottom foldable panels (1004, 908, 1005, 909) are unfolded.

9. The method of claim 6, wherein when said structure is in an erected position the at least one outer support panel (903, 904) and the auxiliary support panel (1007, 905) are generally parallel to each other.

10. The method of claim 9, wherein when said structure is in an erected position the at least one outer support panel (903, 904) and the auxiliary support panel (1007, 905) are spaced apart.

11. The method of claim 9, wherein when said structure is in an erected position said first and second structure panels (901, 902) are generally parallel to each other.

12. The method of claim 11, wherein when said structure is in an erected position said first and second structure panels (901, 902) are spaced apart.

13. A collapsible structure comprising:

first and second structure panels (901, 902);

an outer support panel (903) and an auxiliary support panel (1007), each one of said outer (903) and auxiliary (1007) support panels is connected to said first and second structure panels (901, 902) via two support folding lines (911, 912) at opposite sides of said support panels;

an inner support panel (1006); and at least one foldable panels (1004, 1005), each one of said at least one foldable panels is connected to said auxiliary support panel (1007) and to the at least one inner support panel (1006) at its opposite sides;

wherein when said structure is in a collapsed position, the structure panels (901, 902), the auxiliary support panel (1007) and the outer support panel (903) are adjacent and generally parallel to each other; and wherein when said structure is in an erected position, the auxiliary support panel (1007) is spaced part from the outer support panel (903) and said first and second structure panels (901, 902) are spaced apart.

* * * * *